US007172492B2

(12) United States Patent
Kubota

(10) Patent No.: US 7,172,492 B2
(45) Date of Patent: Feb. 6, 2007

(54) POLISHING METHOD AND POLISHING SYSTEM

(75) Inventor: Takeo Kubota, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/231,755

(22) Filed: Sep. 22, 2005

(65) Prior Publication Data

US 2006/0068684 A1 Mar. 30, 2006

(30) Foreign Application Priority Data

Sep. 22, 2004 (JP) ..... 2004-275562

(51) Int. Cl.
*B24B 49/12* (2006.01)

(52) U.S. Cl. ..... 451/8; 451/6

(58) Field of Classification Search ..... 451/6, 451/5, 8, 41, 288, 287
See application file for complete search history.

(56) References Cited

U.S. PATENT DOCUMENTS 5,676,590 A * 10/1997 Hiraoka ..... 451/287
6,028,006 A 2/2000 Bawa et al.
6,043,096 A * 3/2000 Evtodienko et al. ..... 436/39
6,071,818 A * 6/2000 Chisholm et al. ..... 438/692
2005/0226767 A1* 10/2005 Klocke ..... 422/58

FOREIGN PATENT DOCUMENTS

JP 04-232283 * 8/1992 ..... 451/6
JP 2000-225558 8/2000

OTHER PUBLICATIONS

Fukushima, et al., "Method of Manufacturing Semiconductor Device", U.S. Appl. No. 11/051,624, filed Jan. 27, 2005.

* cited by examiner

*Primary Examiner*—Robert A. Rose
(74) *Attorney, Agent, or Firm*—Finnegan, Henderson, Farabow, Garrett & Dunner, L.L.P.

(57) ABSTRACT

A polishing method includes supplying a slurry onto a pad disposed above a turntable while rotating the turntable, and polishing a workpiece disposed on the pad by pressing the workpiece to the pad, and detecting an ion concentration of a specific ion included in the slurry on the pad by using an ion test paper during the polishing.

20 Claims, 4 Drawing Sheets

POLISHING METHOD AND POLISHING SYSTEM

CROSS REFERENCE TO RELATED APPLICATIONS

This application claims benefit of priority under 35 USC §119 to Japanese Patent Application No. 2004-275562, filed on Sep. 22, 2004, the entire contents of which are incorporated by reference herein.

BACKGROUND OF THE INVENTION

1. Field of the Invention

The present invention relates to a method of polishing a workpiece by pressing the workpiece against a pad while supplying a slurry to a top surface of the pad, and a polishing system therefor.

2. Related Art

In a chemical mechanical polishing (CMP), while a slurry is supplied onto a polishing pad and a turntable is rotated, a workpiece is polished. The pH value or the like of the slurry before polishing can be detected by measuring a state of a supply tank of the slurry. When the slurry is supplied onto the polishing pad to carry out polishing, polishing speed and polishing quality varies with the concentration, pH value, flow rate or the like of the slurry supplied onto the polishing pad. Besides, when plural kinds of slurries are mixed to carry out polishing, the polishing speed or polishing quality varies with a mixed degree of the slurries.

To directly monitor the characteristics of the slurry during polishing, a measuring device has to be placed in the vicinity of the polishing pad. However, conventionally, there has been no proposed practical means which can monitor the characteristics without suspending a polishing process. To measure the characteristics of the slurry during polishing without affecting the polishing process, a dedicated measuring device has to be developed, which increases a production cost. Furthermore, a certain space has to be provided for installation of the dedicated measuring device, which may reduce the productivity.

SUMMARY OF THE INVENTION

According to one embodiment of the present invention, a polishing method, comprises:

supplying a slurry onto a pad disposed above a turntable while rotating the turntable, and polishing a workpiece disposed on the pad by pressing the workpiece to the pad; and detecting an ion concentration of a specific ion included in the slurry on the pad by using an ion test paper during the polishing.

Furthermore, according to one embodiment of the present invention, a polishing system, comprises:

a turntable on which a pad is to be disposed, a prescribed location on the pad being provided with an ion test paper which detects an ion concentration of a specific ion included in a slurry on the pad;

a nozzle which is disposed above the turntable and supplies the slurry onto the pad;

a carrier which presses a workpiece against a top face of the pad;

an image-pickup device which takes an image of the ion test paper while rotating the turntable, supplying the slurry from the nozzle onto the pad, and polishing the workpiece by using the carrier; and an analyzer which analyzes the ion concentration based on the picked-up image taken by the image-pickup device.

DETAILED DESCRIPTION OF THE INVENTION

In the following, with reference to the drawings, an embodiment of the present invention will be described.

(First Embodiment)

Figure 1:
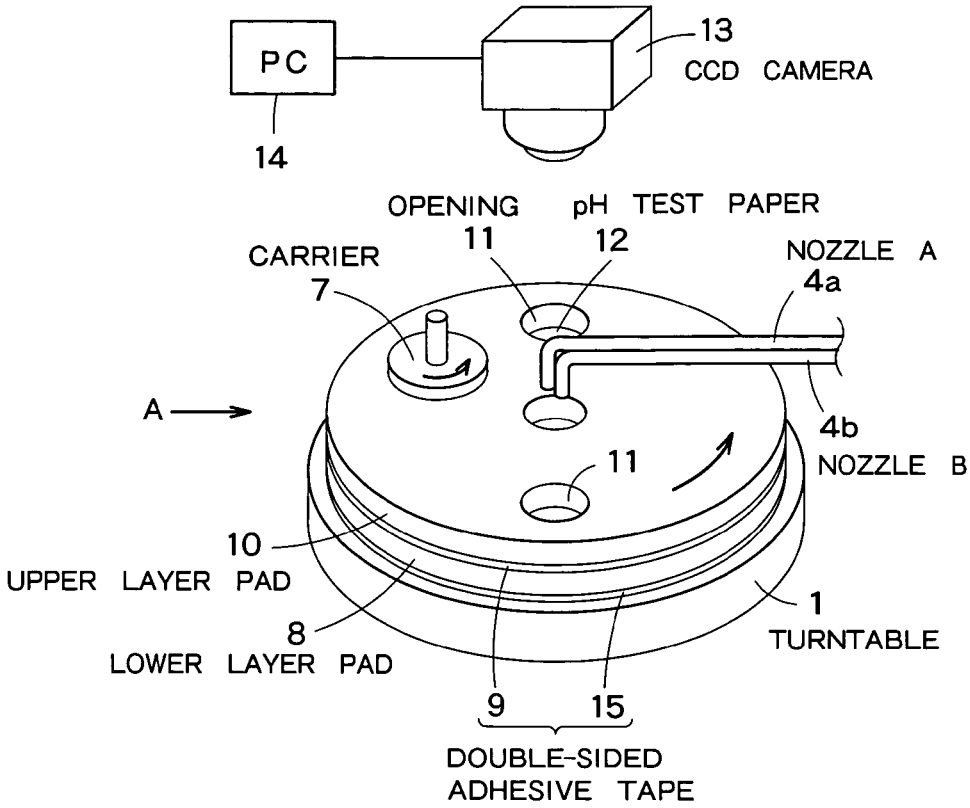
FIG. 1 is a top view of a polishing system that implements a polishing method according to a first embodiment of the present invention.
Figure 2:
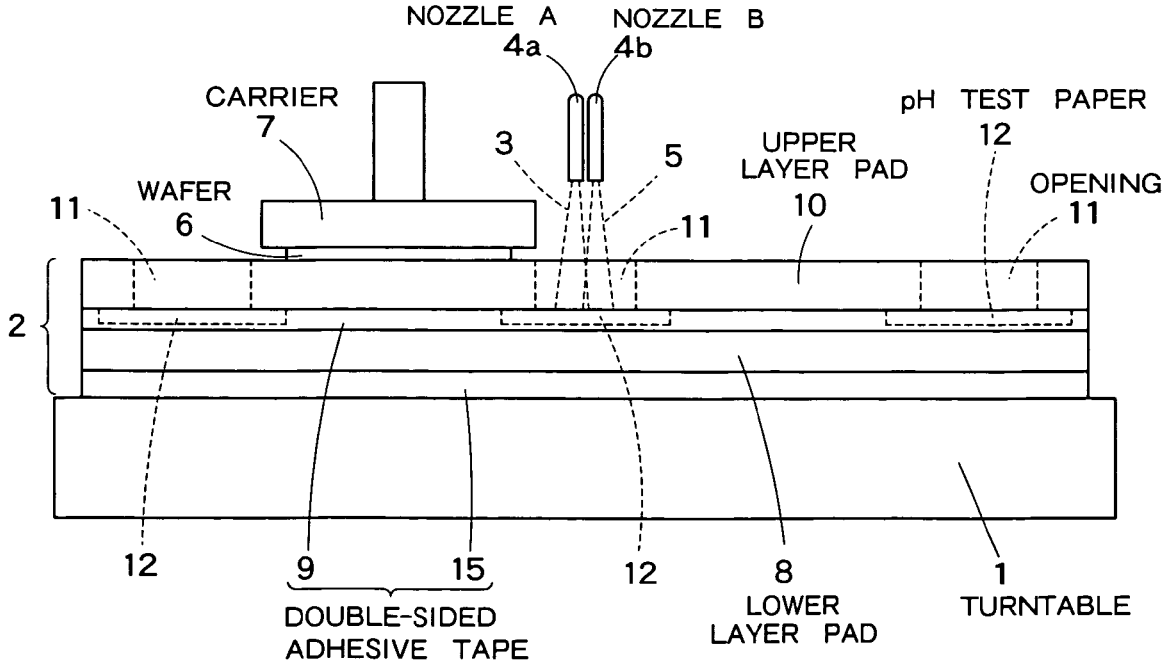
FIG. 2 is a side view seen from A direction in FIG. 1.

FIG. 1 is a top view of a polishing system that implements a polishing method according to a first embodiment of the present invention. FIG. 2 is a side view seen from A direction in FIG. 1.

The polishing system according to the first embodiment has: a turntable 1 capable of rotating around the central axis thereof, on which a pad 2 is disposed; a nozzle 4*a* which supplies a slurry 3 containing abrasive grains and is disposed above the pad 2; a nozzle 4*b* which supplies an oxidant 5 and is disposed above the pad 2; a carrier 7 for pressing a workpiece 6 against the pad 2 for polishing; and a CCD camera 13 disposed above the pad 2. In the following, polishing of a wafer 6 as an example of the workpiece 6 will be described.

There is no specific limitation on the number of nozzles 4*a* or 4*b*. That is, when a mixture of plural kinds of slurries is used, the different slurries may be supplied from different nozzles and mixed on the pad 2 if necessary. Besides, for example, water, used as a solvent, may be supplied from a separate nozzle to dilute the slurry 3 on the pad 2. There is no limitation relating to the material of the slurry 3, and a proper material may be selected depending on the material to be polished. For polishing a Cu material, the slurry 3 including silica abrasive grains, quinaldic acid and a surface-active agent may be used, for example. In this case, the nozzle 4*b* for supplying an oxidant 5 supplies ammonium persulfate (APS), for example. The slurry 3 and the oxidant 5 are directly mixed with each other on the pad 2.

When polishing a Cu material, typically, the pH value of the slurry 3 is about 11, the pH value of the APS is about 5, and the pH value of a mixture of the slurry 3 and the APS is adjusted to be about 9. The slurry 3 and the APS are not mixed in advance, because the slurry 3 is oxidized by the APS. The aqueous APS solution is circulated in an abrasive solution supplying apparatus (not shown), and the pH value thereof is gradually shifted toward higher acidity.

As described above, there are many factors that cause a pH-value variation. Thus, it is desirable to monitor the pH value of the slurry mixture after dropped onto the pad 2. The pH value of the slurry 3 mixed on the pad 2 has various effects on the polishing process. For example, as the pH value decreases, the polishing speed for Cu decreases. On the other hand, as the pH value increases, the polishing speed for a barrier metal with Cu increases, resulting in significant erosion of Cu. In view of such a problem, it is desirable to monitor the pH value and detect any variation of the pH value as early as possible.

The pad 2 rotates integrally with the turntable 1. As shown in FIG. 2, the pad 2 has a two-layer structure, which is composed of a lower pad layer 8 bonded to the turntable 1 by a double-sided adhesive tape 15 and an upper pad layer 10 bonded to the lower pad layer 8 by a double-sided adhesive tape 9. The upper pad layer 10 has openings 11 that penetrate to a bottom face of the upper pad layer 10. pH test papers 12 are disposed on the bottom faces of the openings 11 to be sandwiched between the upper pad layer 10 and the lower pad layer 8. The turntable 1 rotates at high speed, so that a centrifugal force works on the pH test papers 12. As a measure against the centrifugal force, the pH test papers 12 may be bonded to the lower pad layer 8 by an adhesive or the like. In this case, the adhesive or the like which has no effect on the pH value should be desirably selected.

Some of the slurry 3 mixed on the pad 2 flows into the openings 11 and comes into contact with the pH test papers 12 disposed at the bottom of the openings 11. Then, depending on the pH value of the slurry 3, the color of the pH test paper 12 changes.

There are no specific limitations on the number and size of the openings 11. The number and size of the openings 11 may be set not to prevent the polishing process. If the opening 11 is formed along the central axis of the upper pad layer 10, the opening 11 is kept out of a range in which the wafer 6 and the pad 2 are arranged oppositely during rotation of the turntable 1, thereby avoiding adverse affect on the polishing process due to providing the openings 11.

In the case where a plurality of openings 11 are formed, it is desirable that the openings 11 are located at different distances from the central axis of the upper pad layer 10. In an opening 11 close to the nozzles 4*a* and 4*b*, the pH value of the slurry 3 immediately after dropped and mixed on the pad 2 can be detected, while in an opening 11 close to the periphery of the pad 2, the pH value of the slurry 3 exhausted by polishing can be detected.

Commonly, the pad 2 has an opening for facilitating the flow of the slurry 3, and such an opening can be used as the opening 11. In that case, any opening dedicated for pH measurement need not be formed.

Above the opening 11, there is disposed an image-pickup device 13 (a CCD camera, for example) for measuring the color of the pH test papers 12. Images taken by the image pickup device 13 are transmitted to a PC 14, for example, for analysis.

To measure the pH value of the slurry 3 in real time during the polishing process, the image pickup device 13 takes an image of the pH test papers 12 in the openings while rotating the turntable 1. If the opening 11 are formed along the central axis of the upper pad layer 10, a location of the opening 11 does not change even if the turntable 1 rotates. Therefore, the image pickup device 13 can take an image asynchronously with the rotation of the turntable 1. On the other hand, when the image pickup device 13 takes an image of a pH test paper 12 in an opening 11 displaced from the central axis of the upper pad layer 10, the timing of shooting of the image pickup device 13 has to be controlled in synchronization with the rotation of the turntable 1. Specifically, an encoder (not shown) is provided for detecting the amount of rotation of the turntable 1, the output of the encoder is transmitted to the image pickup device 13 to synchronize the timing of shooting of the image pickup device 13 with the rotation of the turntable 1. If the turntable 1 rotates at high speed, the shutter speed is desirably set at a sufficiently high value to avoid blurring of the taken image.

Figure 3:
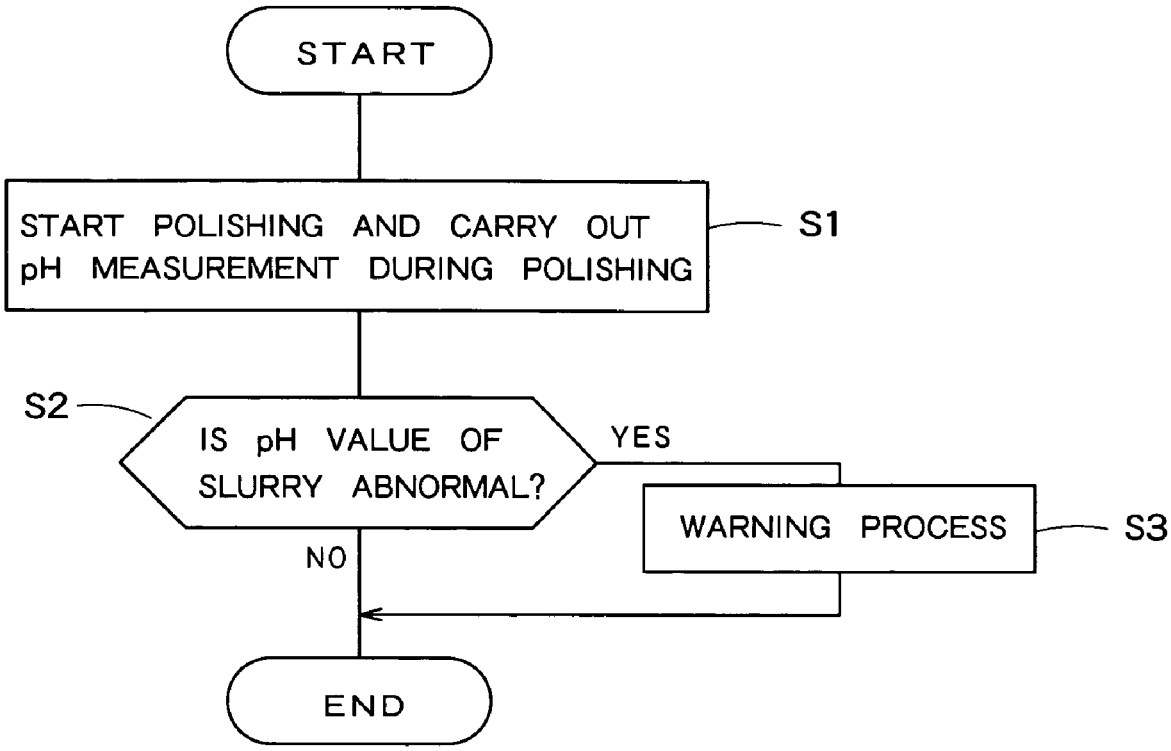
FIG. 3 is a flowchart showing a procedure according to the first embodiment.

FIG. 3 is a flowchart showing a procedure according to the first embodiment. In the following, the polishing method according to the first embodiment will be described with reference to the flowchart. In the following description, it is supposed that a Cu layer formed on the wafer 6 is polished using the slurry 3 containing quinaldic acid. In addition, it is supposed that a plurality of openings 11 are formed in the upper pad layer 10 of the pad 2.

While rotating the turntable 1, the slurry 3 and APS are dropped from the nozzles 4*a* and 4*b*, respectively, and a waiting operation is conducted until the turntable 1 rotates stably, and the slurry 3 and the APS are adequately mixed with each other on the pad 2. Then, the wafer 6 to be polished is placed on the carrier 7 and pressed against the pad 2, and the polishing of the wafer 6 is started. Then, during polishing, the image pickup device 13 takes images of the pH test papers 12 in the openings 11 at regular time intervals, and the PC 14 analyzes a change of color of the pH test papers 12 (step S1). Any method can be used for analyzing the change of color of the pH test papers 12. For example, spectral analysis may be used. The color change analysis can be automatically carried out, or a human can see a display screen of a PC 14 to detect the color change.

Then, based on the pH measurement, it is determined whether the pH value of the slurry 3 is abnormal or not (step S2). If the pH value is abnormal, a predetermined warning process is conducted (step S3). As the warning process, a warning sound is produced, or a warning message is displayed on a monitor screen (not shown), for example. The warning process is intended to immediately stop the polishing process when the pH test paper 12 of the slurry 3 exhibits a color completely different from the colors previously expected, because there is high possibility that cannot properly conduct the polishing process.

If it is determined that the pH value is not abnormal in step S2, the procedure is ended. The procedure from step S1 to step S3 is repeated at regular time intervals during the polishing process.

The processing of step S2 described above may be modified, and it may be determined whether or not the polishing process is completed based on the change of color of the pH test paper 12. In this case, it is determined whether or not the pH test papers 12 placed in different openings at different distances from the central axis of the pad 2 exhibit substantially the same color. If the pH test papers 12 in the different openings 11 exhibit different colors, the procedure of step 1 is conducted continuously. If the pH test papers 12 in the different openings 11 exhibit about the same color, it can be considered that the material to be removed by polishing has been removed, and thus, the polishing process is ended.

For example, in the case of polishing Cu, the pH value is shifted toward higher acidity, because persulfuric acid in the APS is decomposed, and ammonia in the APS is consumed. However, as the polishing proceeds and there remains no Cu to be removed, decomposition of persulfuric acid in the APS and consumption of ammonia in the APS are stopped, and a difference between the pH value of the slurry in an opening 11 close to the center of the pad 2 and the pH value of the slurry in an opening 11 close to the periphery of the pad 2 becomes small. In other words, the pH test papers 12 in the openings 11 become substantially the same color. In this way, by comparing the colors of pH test papers 12 in a plurality of openings 11 with each other, whether or not the polishing of Cu is completed can be determined accurately.

As described above, according to the first embodiment, openings 11 are formed in the upper pad layer 10 of the pad 2, the pH test papers 12 are disposed in the openings 11, respectively, and a change of colors of the pH test papers 12 caused by the slurry 3 which is supplied onto the pad 2 and flows into the openings 11 during polishing is detected. Thus, the pH value of the slurry 3 can be analyzed in real time during polishing, and it can be quickly determined whether or not the constituents of the slurry 3 are abnormal. Furthermore, if a plurality of openings 11 are formed at different distances from the central axis of the upper pad layer 10, and the pH test papers 12 are disposed in the respective openings 11, both the pH value of the slurry 3 immediately after dropped onto the pad 2 and the pH value of the slurry 3 after some of the constituents thereof is consumed by the polishing process can be detected. Thus, by comparing the pH values with each other, whether or not the polishing process is completed can be determined readily and accurately.

(Second Embodiment)

According to a second embodiment, the pH test paper 12 is disposed at a place different from that in the first embodiment.

Figure 4:
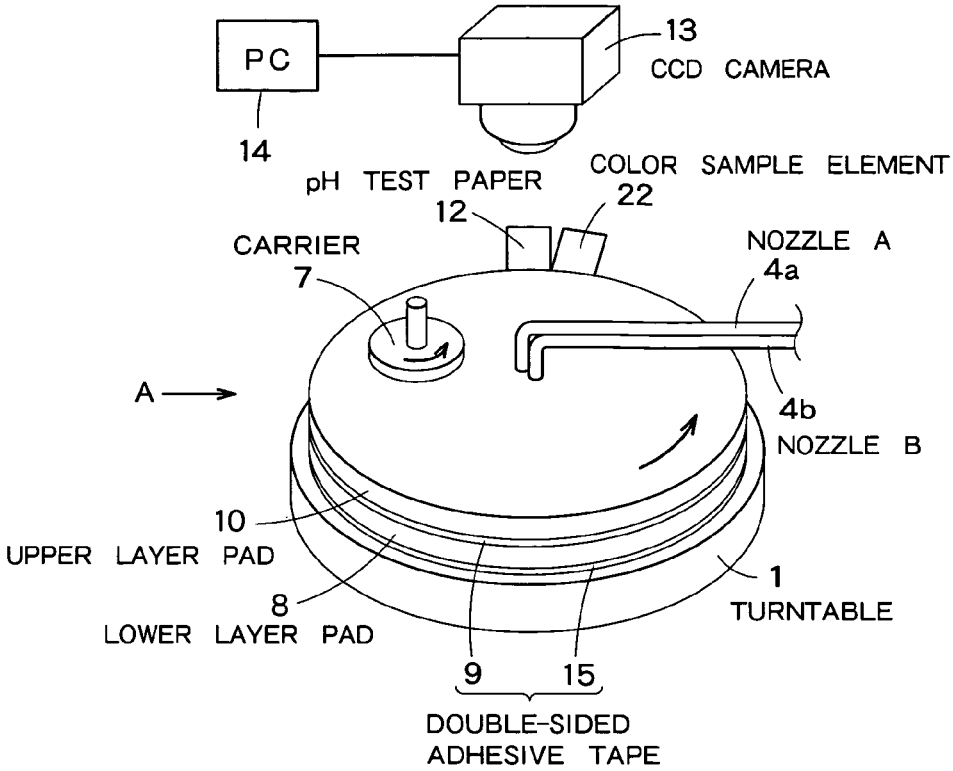
FIG. 4 is a top view of a polishing system that implements a polishing method according to the second embodiment of the present invention.
Figure 5:
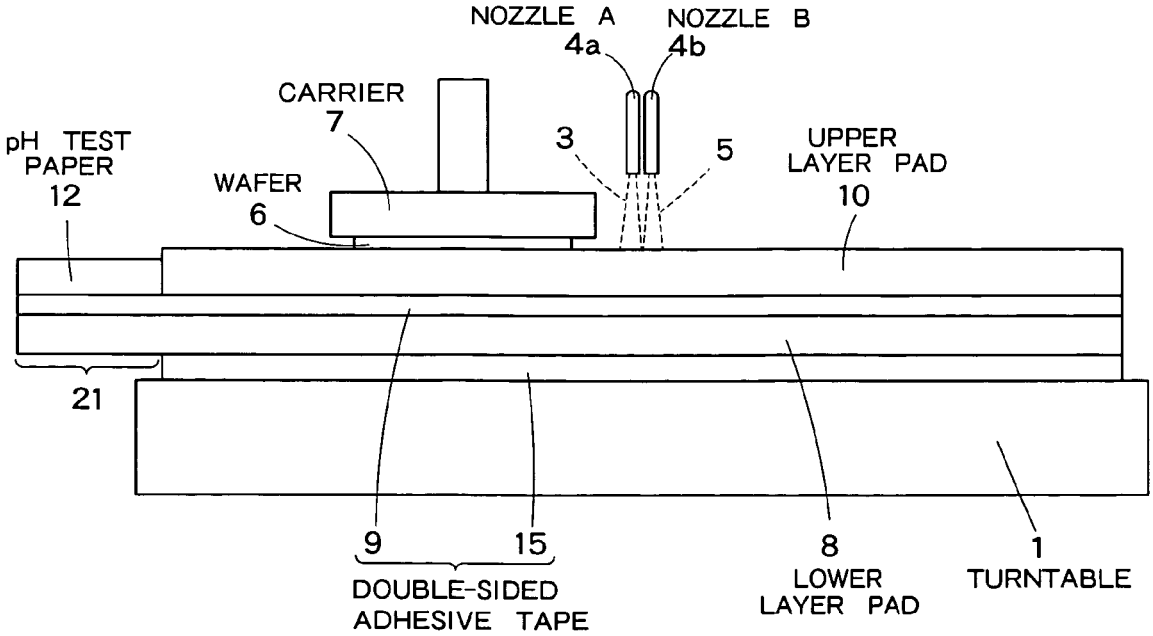
FIG. 5 is a side view seen from A direction in FIG. 4.

FIG. 4 is a top view of a polishing system that implements a polishing method according to the second embodiment of the present invention. FIG. 5 is a side view seen from A direction in FIG. 4.

As can be seen from FIG. 5, the polishing system according to the second embodiment differs from the polishing system shown in FIG. 2 in structure of a pad 2. The pad 2 is composed of a lower pad layer 8 bonded to a turntable 1 by a double-sided adhesive tape 15 and an upper pad layer 10 bonded to the lower pad layer 8 by a double-sided adhesive tape 9. A part in the vicinity of outer circumference of the lower pad layer 8 protrudes from the turntable 1 to form a protrusion 21. The protrusion 21 has enough area to attach the pH test paper 12 and a color sample element 22 with a reference color, and the pH test paper 12 and the color sample element 22 are attached to the top surface of the protrusion 21 (at substantially the same level as the bottom surface of the upper pad layer 10). The pH test paper 12 is detachable and may be bonded to the protrusion 21 by a double-sided adhesive tape so as not to peel off during polishing. In this case, it is desirable to select the double-sided adhesive tape which has no effect to the pH value.

Unlike the first embodiment, the pH test paper 12 according to the second embodiment is detachable. Therefore, when the pH test paper 12 becomes deteriorated due to repeated use for pH measurement, the pH test paper 12 can be easily replaced without disassembly of the pad 2 and the turntable 1. Thus, according to the second embodiment, the maintainability is improved.

Above the pad 2, an image pickup device 13 (a CCD camera, for example) is disposed to detect a change of color of the pH test paper 12. Images taken by the image pickup device 13 are transmitted to a PC 14, for example, for analysis. The image pickup device 13 is disposed at a position where it can take images of both the pH test paper 12 and the color sample element 22.

The color sample element 22 is used as a reference color in the case of determining the color of the pH test paper 12. If the polishing system has color tone data relating to the reference color in advance, the color of the pH test paper 12 can be determined without the color sample element 22. However, depending on the environmental conditions of the polishing system, the type of illumination, the image-taking characteristics of the image pickup device 13 or the like, the taken image does not always exhibit the actual color. However, according to the second embodiment, the color sample element 22 is disposed close to the pH test paper 12, so that images of the pH test paper 12 and the color sample element 22 can be taken under as similar conditions as possible. Then, the obtained color tone data of the two are compared with each other.

The protrusion 21 on which the pH test paper 12 and the color sample element 22 are mounted is formed only at a predetermined part of the pad 2. Therefore, images of the pH test paper 12 and the color sample element 22 are taken in synchronization with the rotation of the turntable 1. Specifically, an encoder (not shown) that detects the amount of rotation of the turntable 1 transmits a signal indicating the detected amount of rotation to the image pickup device 13, and the image pickup device 13 takes an image of the pH test paper 12 and the color sample element 22 at the moment when they pass through a point where the image pickup device 13 can take an image thereof.

Unlike the first embodiment, since the pH test paper 12 is provided only in the vicinity of outer circumference of the pad 2, the pH value of a slurry 3 immediately after dropped onto the pad 2 cannot be measured. However, the slurry 3 uniformly spreads toward the outer periphery of the pad 2 by the centrifugal force during polishing. Therefore, even if the pH test paper 12 is disposed at the vicinity of outer circumference of the pad 2, it is possible to accurately measure the pH value of the slurry 3 on the pad 2.

Figure 6:
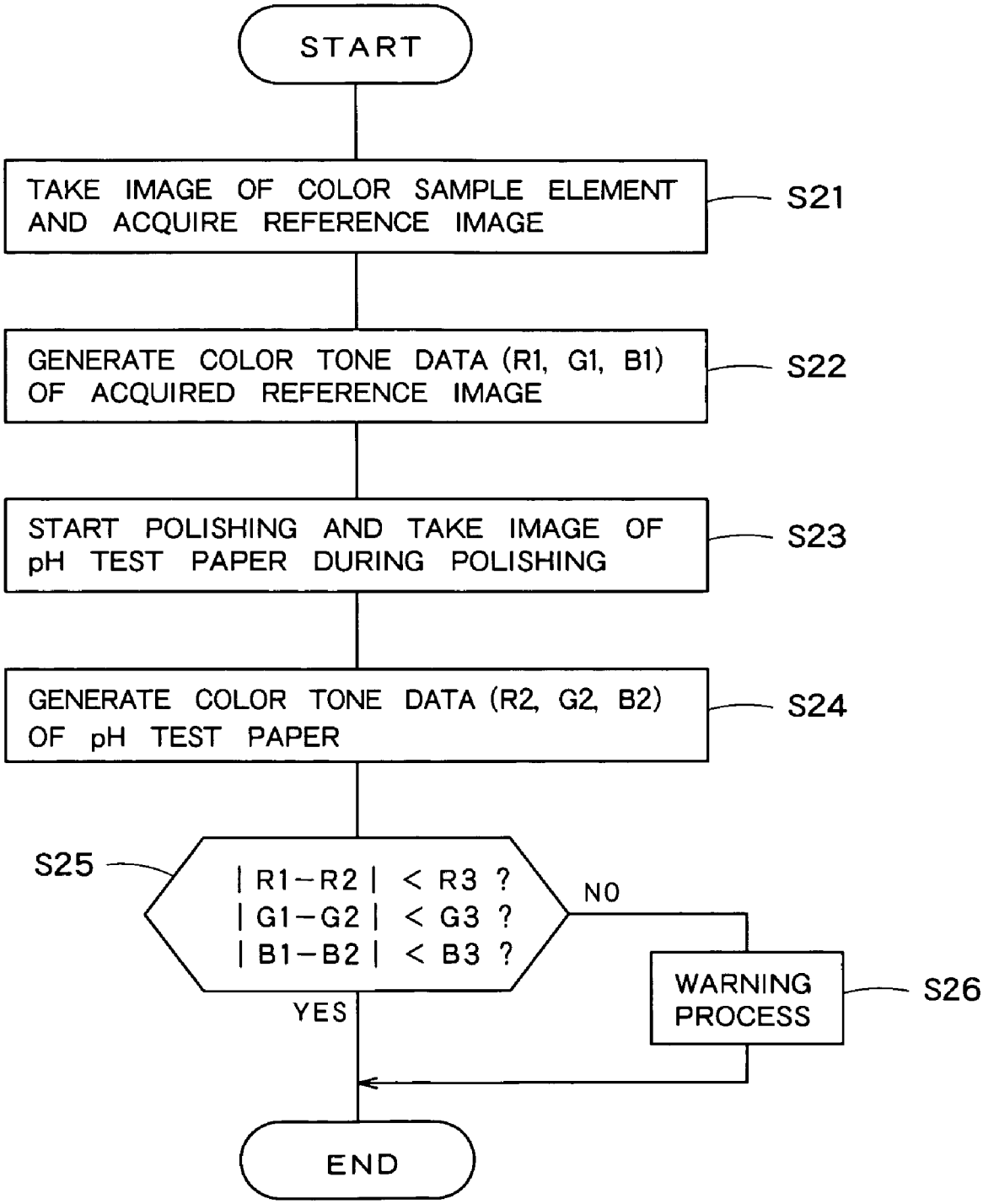
FIG. 6 is a flowchart showing a procedure according to the second embodiment.

FIG. 6 is a flowchart showing a procedure according to the second embodiment. In the following, a polishing method according to the second embodiment will be described with reference to the flowchart.

The slurry 3 is dropped onto the pad 2, a workpiece 6 is pressed against the pad 2 by means of a carrier 7, and then the polishing of the workpiece 6 is started. The image pickup device 13 takes an image of the color sample element 22, thereby obtaining a reference image (step S21). In order that the image-pickup condition for the color sample element 22 is as similar as possible to that for the pH test paper 12, it is desirable to take an image of the color sample element 22 in synchronization of the rotation of the turntable 1 during actual polishing.

The color sample element 22 is preliminarily set to a color in accordance with a pH value by chemical reaction of the polishing workpiece and the slurry, for example.

Then, the color tone of the obtained reference image is digitized to produce color tone data (step S22). For example, as the color tone data, 256-gray-level data (R1, G1, B1) for a red (R) component, a green (G) component and a blue (B) component is produced. The produced data is saved in a storage device (not shown).

Then, during polishing, the image pickup device 13 takes an image of the pH test paper 12 (step S23). This image is also taken in synchronization with the rotation of the turntable 1.

Then, the color tone of an image of the pH test paper 12 is digitized to produce color tone data (R2, G2, B2) (step S24).

Then, for each of red, green and blue, it is determined whether the difference between the color tone data (R1, G1, B1) of the reference image and the color tone data (R2, G2, B2) of an image of the pH test paper 12 is less than a predetermined value (R3, G3, B3) (step S25). If it is determined that the difference is less than the predetermined value, it can be considered that there is no problem, and thus, the procedure is ended. On the other hand, if it is determined that the difference is equal to or more than the predetermined value, it can be considered that the pH value of the slurry has changed, such as when the polishing process has been completed, and thus, a predetermined warning process is conducted (step S26). As the warning process, a warning sound is produced, or a warning message indicating that the pH value of the slurry has changed is displayed on a display device (not shown), for example.

As an alternative to step S26, the warning process may be conducted when it is determined that the difference between the color tone data (R1, G1, B1) of the reference image and the color tone data (R2, G2, B2) of an image of the pH test paper 12 is less than a predetermined value. For example, once the polishing is completed, the chemical reaction between the slurry and the workpiece stops. Thus, if the color sample element 22 having a color of the pH test paper 12 at a moment when the polishing process is ended is provided, it is possible to determine the end of the polishing process at a moment when a difference between the color of the pH test paper 12 and the color of the color sample element 22 becomes almost zero.

As described above, according to the second embodiment, since the pH test paper 12 is disposed on the protrusion 21 formed at the vicinity of outer circumference of the pad 2 for pH-value measurement, the pH test paper 12 can be easily replaced when the pH test paper 12 becomes deteriorated after repeated use for pH measurement, thereby improving operability.

Furthermore, since the color sample element 22 is disposed adjacent to the pH test paper 12, and the taken image of the pH test paper 12 is compared against the reference image obtained by taking an image of the color sample element 22, the color of the pH test paper 12 can be determined independently of the environmental conditions of the polishing system or the image-taking characteristics of the image pickup device 13, thereby improving accuracy of pH-value measurement.

(Other Embodiments)

According to the first and second embodiments described above, the pH value of the slurry is measured using the pH test paper 12. The pH measurement measures the hydrogen ion concentration in a material Besides the pH measurement, there are many ion concentration measurements.

Therefore, the present invention can be applied to various kinds of ion test paper other than the pH test paper 12 which are used for measuring the concentration of a particular kind of ion in the slurry. For example, to measure the concentration of Cu ions, an ion test paper for copper ions can be used.

What is claimed is:

1. A polishing method, comprising:

supplying a slurry onto a pad disposed above a turntable while rotating the turntable, and polishing a workpiece disposed on the pad by pressing the workpiece to the pad; and detecting an ion concentration of a specific ion included in the slurry on the pad by using an ion test paper during the polishing, wherein the pad has a first layer disposed on the turntable, and a second layer which is provided on the first layer and has at least one opening penetrating to a bottom face thereof;

an image-pickup device takes an image of the ion test paper disposed inside of the opening; and the ion concentration is detected based on the image taken by the image-pickup device.

2. A polishing method according to claim 1, wherein the ion test paper is disposed between the first layer and the second layer in accordance with a location of the opening formed on the second layer.

3. A polishing method according to claim 1, wherein a plurality of openings are formed at different distances from a central axis for rotation of the pad, and the ion test paper is provided inside of each of the plurality of openings.

4. A polishing method according to claim 3, wherein one opening among the plurality of openings is formed at a location of the central axis of the pad, and the ion test paper is provided inside of the opening.

5. A polishing method according to claim 4, wherein the other opening among the plurality of openings is formed in the vicinity of an outer edge portion of the pad, and the ion test paper is provided inside of the other opening.

6. A polishing method according to claim 1, wherein the image-pickup device takes the image of the ion test paper in synchronization with the rotation of the pad.

7. A polishing method according to claim 1, wherein the image-pickup device takes the image of the ion test paper inside of the opening formed at a location of a central axis for rotation of the pad at asynchronous timings with the rotation of the pad, and takes the image of the ion test paper inside of the opening formed at a different location from the central axis for rotation of the pad in synchronization with the rotation of the pad.

8. A polishing method according to claim 1, wherein a determination is made whether or not the ion concentration is abnormal based on the ion concentration detected by using the ion test paper;

if it is determined to be abnormal, a predetermined warning process is carried out.

9. A polishing method according to claim 8, wherein a determination is made whether or not the warning process is carried out based on a result of comparing a color tone value of an image of the ion test paper taken by an image-pickup device with that of a predetermined reference color.

10. A polishing method according to claim 3, wherein the polishing is continued until colors of a plurality of ion test papers corresponding to the plurality of openings become equal substantially.

11. A polishing method, comprising:

supplying a slurry onto a pad disposed above a turntable while rotating the turntable, and polishing a workpiece disposed on the pad by pressing the workpiece to the pad; and detecting an ion concentration of a specific ion included in the slurry on the pad by using an ion test paper during the polishing, wherein the ion concentration is detected by the ion test paper disposed on a protrusion in an outer edge portion of the pad.

12. A polishing method according to claim 11, wherein the ion test paper and a color sample element with a reference color are disposed on the pad.

13. A polishing method according to claim 12, wherein the ion test paper and the color sample element are taken images by an image-pickup device under the same image-pickup condition; and the ion concentration is detected based on the images taken by the image-pickup device.

14. A polishing method according to claim 13, wherein a determination is made whether a warning process is carried out based on a result of comparing a color tone value of the image corresponding to the ion test paper with the color tone value of the image corresponding to the color sample element.

15. A polishing method according to claim 13, wherein the image-pickup device takes the images of the ion test paper and the color sample element in synchronization with rotation of the pad.

16. A polishing method according to claim 13, wherein the polishing is continued until a difference between a color tone value of the image corresponding to the ion test paper and a color tone value of the image corresponding to the color sample element become a value within a range predetermined in advance.

17. A polishing system, comprising:

a turntable on which a pad is to be disposed, a prescribed location on the pad being provided with an ion test paper which detects as ion concentration of a specific ion included in a slurry on the pad;

a nozzle which is disposed above the turntable and supplies the slurry onto the pad;

a carrier which presses a workpiece against a top face of the pad;

an image-pickup device which takes an image of the ion test paper while rotating the turntable, supplying the slurry from the nozzle onto the pad, and polishing the workpiece by using the carrier; and an analyzer which analyzes the ion concentration based on the picked-up image taken by the image-pickup device.

18. A polishing system according to claim 17, wherein the pad includes a first layer disposed on the turntable; and a second layer which is provided on the first layer and has at least one opening penetrating to a bottom face thereof; and the image-pickup device taking an image of the ion test paper disposed inside of the opening.

19. A polishing system according to claim 17, wherein the pad has a protrusion disposed in an outer edge portion thereof; and the image-pickup device takes the image of the ion test paper disposed on the protrusion.

20. The polishing method according to claim 11, wherein an image-pickup device takes an image of the ion test paper in synchronization with the rotation of the pad.

* * * * *